US005516490A

United States Patent [19]

Sanadi

[11] Patent Number: 5,516,490

[45] Date of Patent: *May 14, 1996

[54] APPARATUS FOR PREVENTING CROSS-CONTAMINATION OF MULTI-WELL TEST PLATES

[75] Inventor: Ashok R. Sanadi, Arlington, Va.

[73] Assignee: Sanadi Biotech Group, Inc., Tampa, Fla.

[ * ] Notice: The portion of the term of this patent shall not extend beyond the expiration date of Pat. No. 5,342,581.

[21] Appl. No.: 243,890

[22] Filed: May 17, 1994

Related U.S. Application Data

[63] Continuation of Ser. No. 49,171, Apr. 19, 1993, Pat. No. 5,342,581.

[51] Int. Cl.[6] ..... B01L 11/00

[52] U.S. Cl. ..... 422/101; 422/102; 436/177; 436/178; 435/288.4; 435/297.5; 435/305.3

[58] Field of Search ..... 422/58, 69, 101, 422/102, 104; 435/301, 311; 436/165, 177, 178, 809

[56] References Cited

U.S. PATENT DOCUMENTS

| | | | |
|---|---|---|---|
| 3,206,017 | 9/1965 | Williams | 206/56 |
| 3,302,854 | 2/1967 | Midgley et al. | 229/43 |
| 3,366,265 | 1/1968 | Hesselbarth | 220/23.4 |
| 4,246,339 | 1/1981 | Cole et al. | 435/7 |
| 4,392,389 | 7/1983 | Eckstein et al. | 73/864.91 |
| 4,493,815 | 1/1985 | Fernwood et al. | 422/101 |
| 4,626,509 | 12/1986 | Lyman | 435/287 |
| 4,704,255 | 11/1987 | Jolley | 422/101 |
| 4,777,021 | 10/1988 | Wertz et al. | 422/101 |
| 4,895,706 | 1/1990 | Root et al. | 422/102 |
| 4,902,481 | 2/1990 | Clark et al. | 422/101 |
| 4,927,604 | 5/1990 | Mathus et al. | 422/101 |
| 4,948,442 | 8/1990 | Manns | 156/73.1 |
| 4,948,564 | 8/1990 | Root et al. | 422/101 |
| 5,011,779 | 4/1991 | Maimon | 435/293 |
| 5,014,533 | 4/1992 | Szabados | 210/257.1 |
| 5,038,852 | 8/1991 | Johnson et al. | 165/12 |
| 5,047,215 | 9/1991 | Manns | 422/101 |
| 5,056,427 | 10/1991 | Sakabe et al. | 100/211 |
| 5,076,933 | 12/1991 | Glenn et al. | 210/641 |
| 5,108,704 | 4/1992 | Bowers et al. | 422/70 |
| 5,110,556 | 5/1992 | Lyman et al. | 422/101 |
| 5,112,574 | 5/1992 | Horton | 422/102 |
| 5,130,105 | 7/1992 | Carter et al. | 422/245 |
| 5,133,939 | 7/1992 | Mahe | 422/104 |
| 5,141,719 | 8/1992 | Fernwood et al. | 422/101 |
| 5,178,779 | 1/1993 | Gironda et al. | 210/800 |
| 5,282,543 | 2/1994 | Picozza et al. | 220/225 |

FOREIGN PATENT DOCUMENTS

| | | | |
|---|---|---|---|
| 0311440A2 | 10/1988 | European Pat. Off. | G01N 35/06 |
| 0388159A2 | 3/1990 | European Pat. Off. | B01L 3/00 |

OTHER PUBLICATIONS

Brochure of the BEADPREP 96, Magnetic Separator/Concentrator.

Millititer Filtration System, Bio/Analytical Test Products.

96, 192, and 384 Well Plates for Every Occasion, USA/Scientific Plastics, Inc., 1993.

*Primary Examiner*— James C. Housel
*Assistant Examiner*—Harold Y. Pyon
*Attorney, Agent, or Firm*—Dykema Gossett

[57] ABSTRACT

A multi-well plate which prevents cross-contamination of specimens through the use of a resilient gasket which covers a majority of the top of the plate and is compressed by a lid. It thus provides a sealing assembly for arrays of containers of any size or shape. A multi-well plate of modular construction is also disclosed in which resilient gaskets prevent cross-contamination of samples. The gaskets may be unitary sheets with or without an array of openings corresponding to the well openings or may consist of discrete single-cell gaskets. A multi-well plate in which the wells have conical ends is also provided.

6 Claims, 4 Drawing Sheets

APPARATUS FOR PREVENTING CROSS-CONTAMINATION OF MULTI-WELL TEST PLATES

This is a continuation of application Ser. No. 08/049,171 filed on Apr. 19, 1993 now U.S. Pat. No. 5,342,581.

FIELD OF THE INVENTION

The present invention relates generally to multi-well plates and tube arrays in which various biological and biochemical materials are analyzed or processed. More specifically, the present invention solves the problems associated with cross-contamination of samples which may occur in the use of an array of wells or tubes. In addition, the present invention relates to improved multi-well microfiltration devices.

BACKGROUND OF THE INVENTION

A number of research and clinical procedures require the use of an array of wells or tubes in which multiple samples are placed for screening/evaluation. In general, these multi-well test plates may be classified as those having a single opening at the top through which samples are added and removed and those of the filter-type. The filtration devices have an opening at the top through which a sample is introduced and a second opening at the bottom which is fitted with a filter. These trays are used for a wide variety of biochemical and biological procedures such as polynucleotide amplification and the growth of cell cultures.

With respect to the filtration type plates, there are several conventional constructions. These devices generally have a filter medium which prevents the flow of the sample through the filter until the sample is placed under pressure, either through a positive pressure applied to the top of time plate or, more commonly, by the vacuum extraction of time sample through the filter. In the case of vacuum filtration with a multi-well plate, it is also known to use a gasket limited to the perimeter of the plate-manifold interface, creating a seal such that the vacuum is established more efficiently.

An important disadvantage in the use of a conventional array of tubes mounted within a plate, and with multi-well plates of conventional design (either with or without a filtration feature) is the problem associated with cross-contamination of the specimens. Most biological and biochemical assays and cell culture protocols must be performed with a high degree of stringency in terms of limiting contamination of the samples. Where multiple samples are processed in a confined area, such as an 8×12 format (96 well plate), the risk of cross-contamination between samples is significant. In the case of assays, this cross-contamination may lead to erroneous test results. If a single unitary plastic plate were used as a top or collective lid to close the tops of all the wells or tubes, an inadequate seal would be formed which could allow the migration of sample between wells during handling or simply through condensation and capillary processes. In addition, multi-well arrays which utilize individual stoppers or screw-type caps to close each well are unwieldy and allow the introduction of contaminants as reagents and the like are added to the wells during different stages of an analysis/experiment. This problem is particularly acute when snap-type caps are opened, which frequently produces an aerosol. The aerosol formation may result in cross-contamination between samples. In addition, aerosols may expose technicians to potentially pathogenic microorganisms and the like which may be present in the samples being analyzed. In addition, the conventional tube arrays and multi-well plates are not generally modular in construction. Although incorporated into a single plate, many of these conventional devices still function as discrete elements which are difficult to manipulate during use and often require a transfer of samples which provides additional risks of contamination.

Therefore, it is an object of the present invention to provide a tray assembly having an array of sample containment sites having a design which reduces the risk of cross-contamination between containment sites.

It is still another object of the present invention to provide a multi-well plate or tube array plate in which cross-contamination of samples is significantly reduced by providing a resilient gasket which isolates each containment site.

It is still a further object of the present invention to provide a modular multi-well plate in which a plurality of planar elements that define containment sites are separated by resilient gaskets such that each containment site is substantially isolated. The samples can be filtered without transferring the samples to a separate filtration device.

It is still a further object of the present invention to provide a sample containment assembly which eliminates the requirement of transferring samples between various apparatus during sample processing.

These and other objects and advantages of the present invention will be more fully understood with reference to the drawings.

SUMMARY OF THE INVENTION

Figure 1:
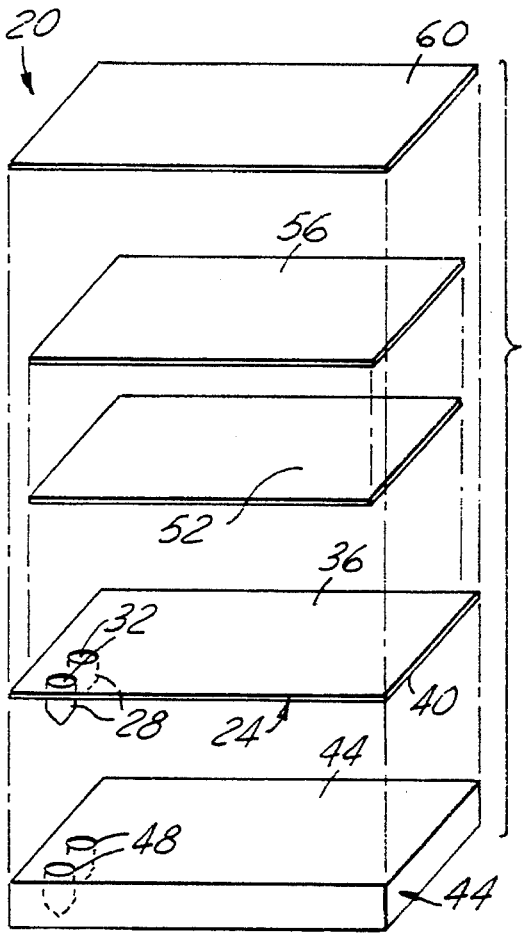
FIG. 1 is an exploded perspective view of a multi-tube tray assembly made in accordance with the present invention.

In one aspect, the present invention provides an apparatus for the analysis or processing of multiple biological or chemical samples having a plurality of containment sites such as wells or tube like vessels. The wells or tubes may be discrete elements temporarily attached to a tray or plate or preferably are formed integrally with the plate. The apparatus further includes a lid which covers the principal or top surface of the plate or tray such that the lid covers all of the openings of the wells or tubes. Between the lid and the principal surface of the tray or plate, a layer of a resilient material such as a synthetic rubber membrane is provided which serves as a gasket. The gasket in one embodiment is a unitary sheet which covers all of the well or tube openings of the plate. Thus, the gasket serves as a top or closure for each specimen chamber. The lid is clamped or otherwise secured to the plate or tray with sufficient force to provide sealing contact between the gasket and the tray or plate surfaces around the well or tube openings such that the apparatus can be placed in various orientations without movement of the samples from their respective containment sites.

In still another aspect, the gasket feature of the present invention comprises a plurality of discrete gaskets each of which covers one or several openings of the plate. The discrete gaskets extend beyond each individual opening a sufficient distance to provide a seal between the individual wells or tubes.

In still another aspect, the gasket feature of the present invention is further provided with openings in register or alignment with each of the openings of the multi-well plate or tray such that access to the individual specimen or sample containment sites may be accessed by simply removing the lid.

In still another embodiment, the apparatus of the present invention includes at least one gasket as described in a modular multi-well plate assembly having one or more filters and/or membranes through which samples from the wells may be filtered and/or absorbed during processing of the samples.

In still another aspect, the present invention provides a multi-well plate in which the bottoms of the wells are conical in shape such that the wells permit more efficient separation of materials through centrifugation and the like.

In still another aspect, a mylar sheet is disposed on top of a gasket having a plurality of openings; the mylar sheet facilitates thermal equilibration during certain processes such as Polymerase Chain Reaction.

Thus, the present invention provides in its broadest aspect an assembly for simultaneously containing biological or chemical materials in separate chambers which has a plate deflating a plurality of containment sites, each such site having an opening at a principal surface of the plate; a sealing layer disposed on and extending over the majority of the principal surface of the plate; and a lid disposed on the sealing layer and compressing the sealing layer on the principal surface of the plate forming a seal which prevents materials from flowing from one containment site to another between the lid and the principal surface of the plate. Therefore, it will be appreciated that it is an important aspect of the present invention that a single lid or top is used in conjunction with the novel gasket of the present invention to seal a plurality of tubes/well openings simultaneously. This is a significant advance over conventional plates having discrete caps or lids for each well.

In another aspect, a modular multi-well plate is provided which has a plurality of bores in its principal surface; an intermediate plate having top and bottom surfaces and defining a plurality of openings, the openings being in alignment with the plurality of bores; a first thin planar gasket defining a plurality of openings, the gasket being disposed between and in contact with the principal surface of the base plate and the bottom surface of the intermediate plate such that a plurality of chambers are defined; a second thin planar gasket disposed on the top surface of the intermediate plate; and a lid disposed on the second gasket and compressing the gasket on the top surface of the intermediate plate such that a seal is formed which prevents cross-contamination of samples in the chambers.

In addition, a multi-well plate is provided which has a plate defining a plurality of wells, each of the wells having an internal annular rim; a gasket disposed on the internal annular rim; and a lid having a projection which mates with and compresses the gasket.

Finally, a multi-well plate is provided having a plate defining a plurality of wells, at least some of the wells having conical bottoms.

These and additional aspects of the present invention will be more fully described in the following detailed description of the preferred embodiments.

DETAILED DESCRIPTION OF THE PREFERRED EMBODIMENTS

Figure 2:
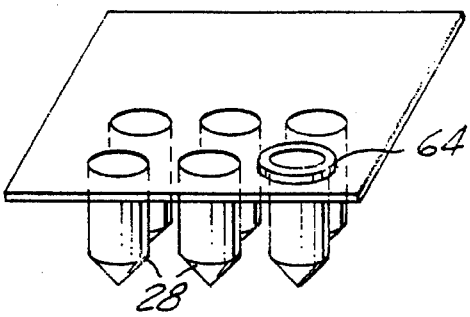
FIG. 2 is a perspective view of the multi-tube plate of the assembly shown in FIG. 1.
Figure 3:
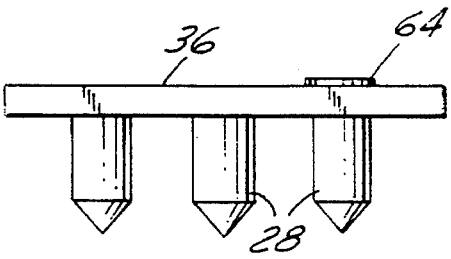
FIG. 3 is a front elevational view of the plate shown in FIG. 2.

Referring now to FIG. 1 of the drawings, tube tray assembly 20 is shown having tube tray 24. Tube tray 24 is also shown in FIGS. 2 and 3 as a plurality of tubes 28 (only two of which are shown in FIG. 1). An opening or mouth 32 is provided on each tube 28 at principal or top surface 36 of tube tray 24. It will be appreciated that tray 24 may be formed as an integral or single-piece structure laving tubes 28 or that tubes 28 may be subsequently attached to tube tray 24 either permanently or temporarily. For example, tube tray 24 could comprise a plate with a plurality of openings in which tubes 28 are held in the nature of a test-tube holder. Tray carrier 44 has a principal surface 44 which mates with lower surface 40 of tray 24. Tubes 28 are received within tube receiving bores 48 of carrier 44.

Following the introduction of samples into tubes 28 through openings 32, sealing layer or resilient gasket 52, having generally the same geometry in this embodiment as principal surface 36 of tray 24 is placed on top of tray 24 such that it covers the majority of principal surface 36, including openings 32. Resilient gasket 52 may be formed of a number of materials. In general, gasket 52 comprises a resilient sheet or membrane which should be inlet with respect to the samples within tubes 28. Gasket 52 may be formed of various other materials and may include a coating of an inert, relatively inflexible polymer such as Teflon™ which is applied in a thickness which does not interfere with the resiliency of gasket 52. In some applications, however, gasket 52 and/or mylar sheet 56 may have a coating of one or more materials such that it binds selectively to a component of the sample. For example, where the sample contains biotinylated materials, gasket 52 and/or mylar sheet 56 may include a coating of streptavidin or avidin to form an avidin/biotin bond. Resilient gasket 52 may be formed of synthetic rubber-like polymers such as silicone rubber, sodium polysulfide, polychloroprene (neoprene), butadiene-styrene copolymers (SBR), and the like. Resilient gasket 52 should have sufficient resiliency Such that when compressed it forms an hermetic seal between openings 32 on principal surface 36 of tube tray 24 and is relatively thin, for example, the thickness of a sheet of filter paper. It may be suitable in some applications to form resilient gasket 52 as an array of gasket discs or annular rings formed on a paper or mylar membrane or the like. Numerous methods of attaching the preferred gasket materials to a membrane will be known to those skilled in the art. Thus, in one embodiment, and referring to FIG. 6A, openings 130 would actually be discs or annular rings of resilient gasket material mounted on a substrate 128.

In one embodiment, which will be explained more fully in connection with FIG. 6A, gasket 52 may be provided with an array of openings corresponding to the tube openings. Where gasket 52 has these corresponding openings, thermal equilibrium sheet 56, for example a mylar sheet, is disposed on top of resilient gasket 52. It will be appreciated that in a number of biochemical processes, for example Polymerase Chain Reaction, it is necessary to achieve rapid thermal equilibration. This is facilitated by sheet 56. Most preferably, where gasket 52 has the construction shown in FIG. 6A, i.e, with and array of openings corresponding to the tube openings, thermal equilibrium sheet 56 is most preferably bonded to gasket 52 such that it forms a laminate sheet. It may also be suitable in some applications to bond sheet 56 to lid 60 or to provide reinforcing rods or strips on or in sheet 56 to provide it with additional stiffness. Stiffened in this manner, sheet 56 could be provided with a plastic tab at one or more edges such that it could be handled without touching the mylar itself.

In order to form a more complete seal of openings 32 by resilient gasket 52, lid 60 is provided, which in this particular embodiment is disposed directly on sheet 56. Thus, it will be recognized that assembly 20 comprises a series of elements in a stacked arrangement which, in combination, provides an hermetic seal of wells 32.

Referring now to FIGS. 2 and 3 of the drawings, in an optical configuration, tubes 28 are additionally provided with a lip or rim 64 which extends above principal surface 36 of tube tray 24. It will be appreciated that by providing rim 64 the rim surface engages resilient gasket 52 to assist in forming a seal.

Figure 4:
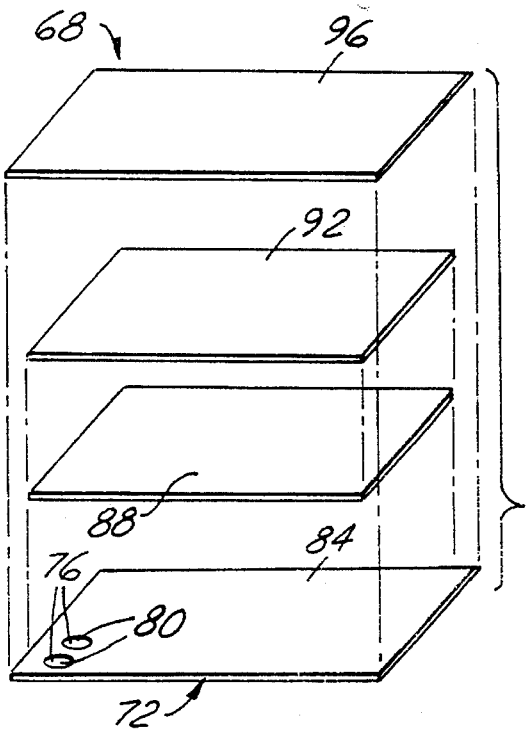
FIG. 4 is an exploded perspective view of a multi-well titer plate assembly made in accordance with the present invention.

Referring now to FIG. 4 of the drawings, multi-well assembly 68 is shown generally having multi-well plate 72 in which a plurality of wells 76 are provided with each well 76 having a well opening 80 on principal surface 84. It will be appreciated that multi-well plate 72 may comprise a conventional microtiter test plate or the like. As will be known, wells 76 in these conventional plates are typically distributed as an array of 96 wells. In this embodiment of the invention, resilient gasket 88 is provided which again covers principal surface 84 in close contact therewith such that it seals wells 76 by covering well openings 80. Thermal sheet 92 is shown disposed on resilient gasket 88, again to provide rapid thermal equilibration if necessary. As previously stated, thermal sheet 92 will be used in that embodiment of the invention which includes a gasket having an array of corresponding openings shown as gasket 128 in FIG. 6A. The aforementioned modifications of thermal sheet 92 are equally applicable to all embodiments of the present invention. It should be understood that a thermal sheet of this type may not the necessary in many applications and will not be needed where the gasket does not have an array of openings. Lid 96 is provided which serves to compress resilient gasket 88 onto principal surface 84 through the use of one or more clamps such as a snap, hinge, sliding catch, or even a hook (not shown in FIGS. 1–4).

Figure 5:
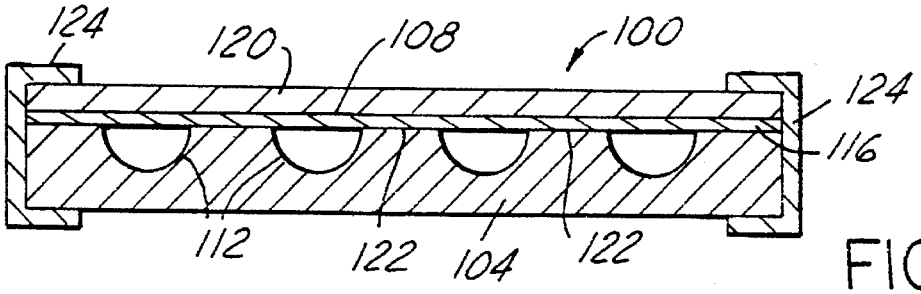
FIG. 5 is a cross-sectional elevational view of a multi-well plate in one embodiment of the present invention.

Referring now to FIG. 5 of the drawings, a multi-well assembly 100 made in accordance with the present invention is shown in cross-section having multi-well plate 104 with principal surface 108. A plurality of wells 112 are formed in plate 104, typically as an array. Resilient gasket 116 is shown disposed on principal surface 108 of multi-well plate 104 in the manner previously described. Lid 120 compresses resilient gasket 116 onto principal surface 108 of multi-well plate 104 to form a seal at regions 122 which, as will be recognized, are those areas of principal surface 108 which surround each well 112. In order to secure lid 120 and resilient gasket 116 in place on multi-well plate 104, clamps 124 are shown which, in this embodiment, comprise simple friction C-clamps or channel clamps. The clamps may be of any convenient construction and may be attached at two or more edges of the assembly as required. It will be appreciated that lid 120 may be covered with contaminators. In the present invention, the lid can be removed print of removal of gasket 116 in a hood in those embodiments in which gasket 116 is bonded to thermal sheet 92. That is is wells 112 will still be covered when lid 120 is removed by virtue of thermal sheet 92 (not shown in FIG. 5) overlying the corresponding opening in gaskets 116.

Figure 6:
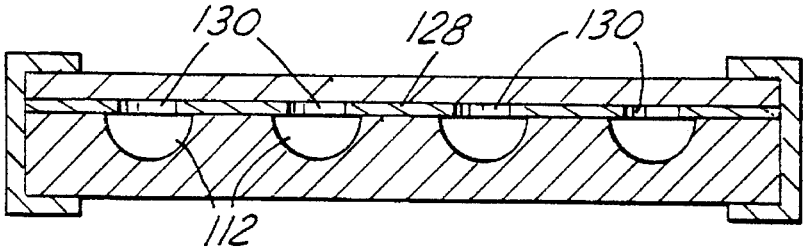
FIG. 6 is a cross-sectional elevational view of a multi-well plate in another configuration in accordance with the present invention.
Figure 6A:
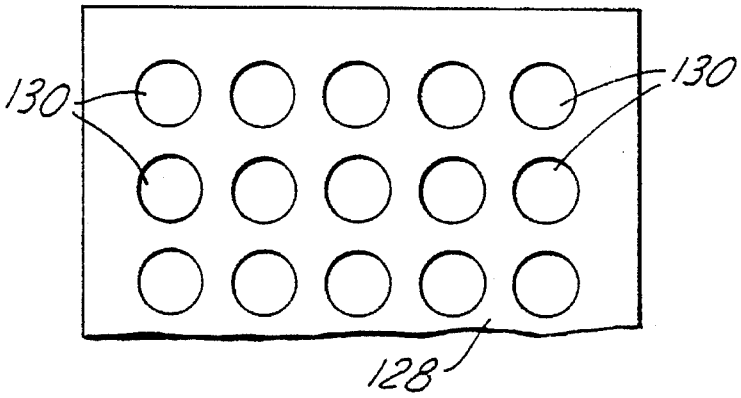
FIG. 6A is a plan view of the gasket depicted in FIG. 6.

Referring now to FIG. 6 of the drawings, in an alternative embodiment, resilient gasket 128 has a plurality of openings 130 in alignment with wells 112. The arrangement of openings 130 in resilient gasket 128 is best shown in FIG. 6A. In this embodiment, openings 130 have a slightly smaller diameter than the openings of wells 112 which contributes to confinement of samples within wells 112 to prevent cross-contamination. It will be appreciated that by providing openings 130 in gasket 128, reagents can be easily added to wells 112 simply by removing clamps 124 and lid 120 from assembly 100. The lid and clamps can then be replaced to close and seal wells 112. Alternatively, where the gasket does not have any openings therein, it may be formed of a self-sealing material such that reagents can be added by way of a syringe or the like.

Figure 7:
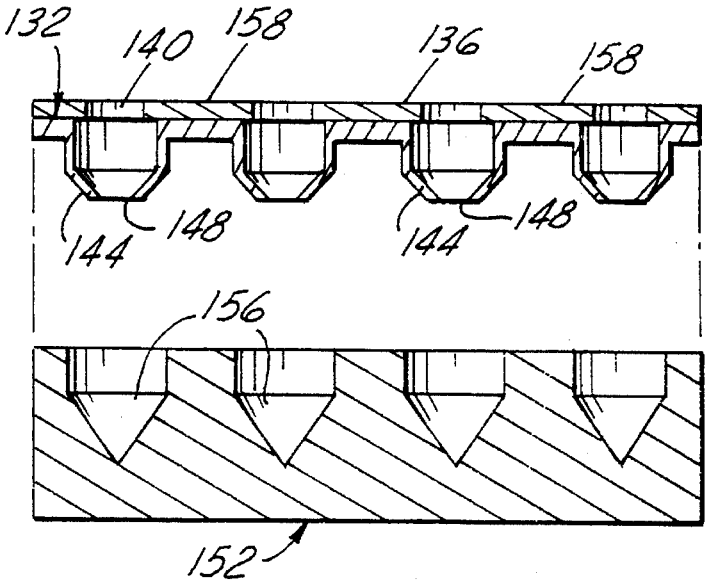
FIG. 7 is a cross-sectional elevational view of a conical-end multi-well plate and carrier in accordance with one aspect of the present invention.

Referring now to FIG. 7 of the drawings, a multi-well plate 132 useful in the present invention is shown having principal surface 136. A plurality of wells 140 are provided having conical ends 144, the exterior and interior of which are both conical. Thus, a multi-well plate is formed as a unitary structure by plastic injection molding or the like, with conical ends 144, which is conveniently adaptable to centrifugation and the like for the separation of phases. Each conical end 144 is provided with a port 148 which may include a filter (not shown) or a cap (not shown). If desired, end 144 may not have a pert, and could be sealed. Carrier 152 is shown having reciprocal conical bores 156 for receiving conical ends 144 of wells 140. Resilient gasket 158 may be provided to perform the sealing function previously explained.

Figure 8:
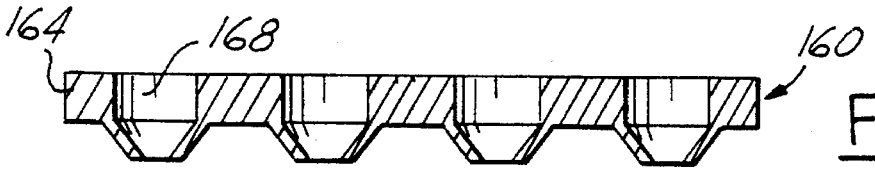
FIG. 8 is a cross-sectional elevational view of another conical-end multi-well plate.
Figure 9:
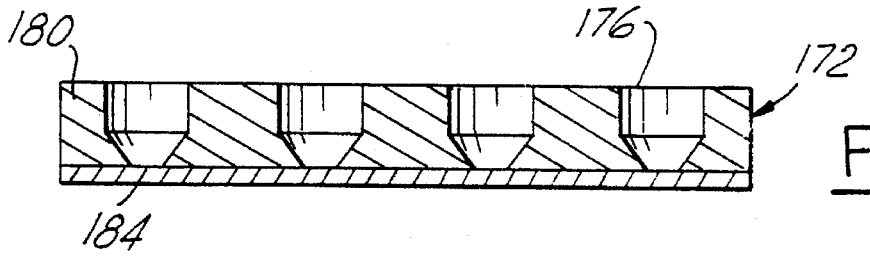
FIG. 9 is a cross-sectional elevational view of another conical-end multi-well plate shown with an exterior filter medium.

In a modification of this unique filter plate design, and referring now to FIG. 8 of the drawings, multi-well filter plate 160 is shown having plate body 164. In this embodiment, plate body 164 extends for the length of vertical side wall portion 168 of multi-well filter plate 160. It will be appreciated that this construction is somewhat more rigid, since body portion 164 is thicker. A still thicker body portion is shown in FIG. 9 wherein multi-well plate 172 with conical wells 176 is shown. It will be noted that in this embodiment body 180 is generally of a thickness equal to the depth of wells 176, i.e., wells 176 are formed as bores with conical ends entirely within body portion 180. A filter 184 is shown closing the ends of wells 176. The filter may be attached by heat sealing to the bottom of the walls of wells 176 and an impermeable thin plastic film placed underneath. The film may be stripped off, and a vacuum then applied underneath with an appropriate manifold. The filter would then be pulled off. The membrane could be a single full sheet. Another modification of the membrane may comprise circles or discs of membrane heat sealed on a mylar sheet. The circles are of a diameter identical to the bottom of the well. The whole sheet would be again sealed by heating or any means so that it could be pulled off after filtration.

Figure 10:
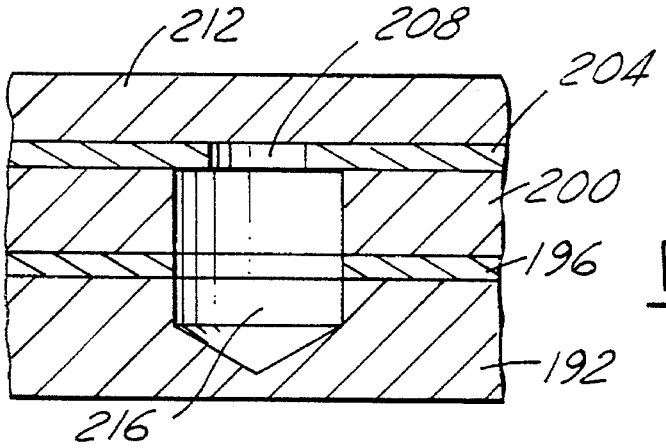
FIG. 10 is a fragmentary cross-sectional elevational view of one well of a multi-well assembly of modular construction made in accordance with the present invention.

In still another embodiment, the present invention provides a modular multi-well plate which facilitates the processing of samples in an automated fashion. Referring now to FIG. 10 of the drawings, modular multi-well filter assembly 188 is shown with one well being illustrated broken-out from the array for simplicity. Modular multi-well filter assembly 188 has well base 192 in sealing engagement with intermediate resilient gasket 196. It is to be understood that the materials previously listed for gaskets used in the present invention are equally applicable to each such gasket described herein. Covering intermediate resilient gasket 196, well body 200 is shown. Together, well body 200 and well base 192 form well chamber 216. Thus, it will be appreciated that intermediate resilient gasket 196 is provided with an opening corresponding generally to the geometry of annular well chamber 216. Overlying well body 200, a second or top gasket 204 is shown which provides a seal between lid 212 and well body 200 in the manner previously described. In this embodiment, top gasket 204 includes an access opening or gasket opening 208. This modular arrangement of elements is held together by a clamp (not shown) which may be similar in design to the clamping arrangement illustrated in FIGS. 5 and 6. In operation, base 192, gasket 196, and body 200 are assembled with their respective openings in register with one another. It will be appreciated that in one embodiment the wells will be arranged in an array, for example, a 96 well plate. Samples are then added to the well chambers 216. Top gasket 204 is then placed on body 200, again, in this embodiment with openings 208 in alignment with the individual wells. Lid 212 is then placed on gasket 204 and is drawn down using clamps (not shown). Lid 212 can be removed and reagents can be added to the sample through access opening 208 of gasket 204. Instead of gasket 204, gasket 128 (FIG. 6A) could be used.

Figure 11:
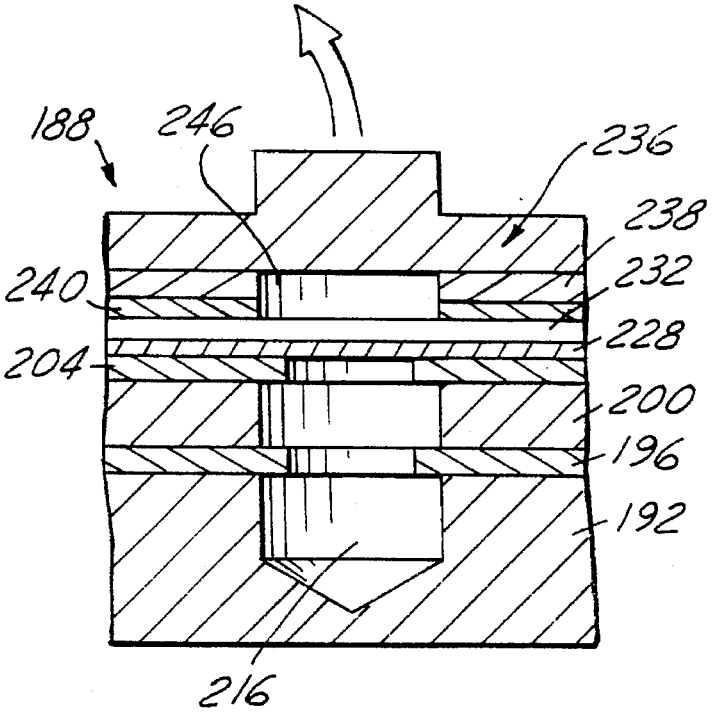
FIG. 11 illustrates the multi-well assembly of FIG. 10 in an filtration mode.

Referring now to FIG. 11 of the drawings, in the second stage or mode, lid 212 has been removed and filter 228, which may be a nitrocellulose membrane or other such filter is placed in contact with top gasket 204 covering the array of wells. Filter 228 may comprise an array of discrete elements such as circular discs laminated to an impermeable mylar sheet or the like. In order to maintain filter 228 in position during vacuum removal of a sample, porous filter support 232 is provided, shown disposed on filter 228. Porous filter support 232 may comprise a number of materials such as polyethylene, polypropylene or Teflon™. Also, a number of suitable manifold arrangements will be known to those skilled in the art.

Figure 12:
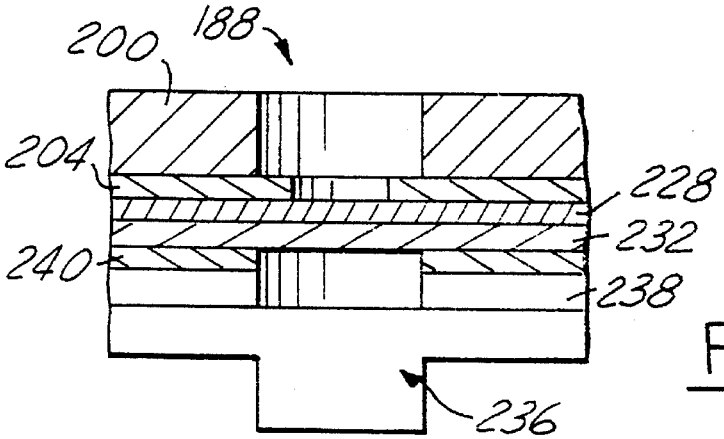
FIG. 12 illustrates the multi-well assembly of FIG. 10 in the filtration mode.

Referring now to FIG. 12 of the drawings, in the third or filtration mode, assembly 188 is inverted, base member 192, and gasket 196 having been removed. A vacuum is applied via vacuum manifold 236 which draws the sample toward filter 228. As the sample passes into filter 228, the desired component of the sample is collected on the filter surface and the filtrate passes through filter 228 and porous support 232 into manifold 236 where it is collected in the conventional manner. The assembly ill this mode can be clamped in any convenient manner. Filter 228 may then be removed for subsequent processing. In some applications it may be suitable to insert a plate (either plastic or metal, for example) between gasket 204 and filter 228 with holes or slots being formed in the plate above the openings of the wells. The blot obtained on the filter from each respective well would then be a slot or dot blot. In another embodiment, a plate of this nature could be used in place of body 200. If so, the bores of the plate would be formed such that they taper toward the dot or slot opening. A rubber lining would be provided around the edges of the holes of the plate on both sides of the plate. Further, an additional gasket (not shown) could be utilized between porous support 232 and filter 228. A plurality of filters and/or membranes could also be used, with gaskets between item. In some applications, it may be suitable to further process the blotted filter by, for example, drying, prehybridization, hybridization, and the like prior to removing filter 228 from assembly 188. After a sample is blotted on filter 228, it may be possible to use an array of punches to punch out the blots which may be collected directly into a 96 well plate for counting radioactivity.

In still another embodiment, and referring again to FIG. 10, assembly 188 could be inverted, and base member 192 removed. Filger 228, support 232 and manifold 236 would be placed on gasket 196, with filter 228 contacting the gasket. The assembly would then be turned right side up and then lid 212 (FIG. 10) removed. A vacuum would then be applied via manifold 236 to blot the samples on the filter.

Figure 13:
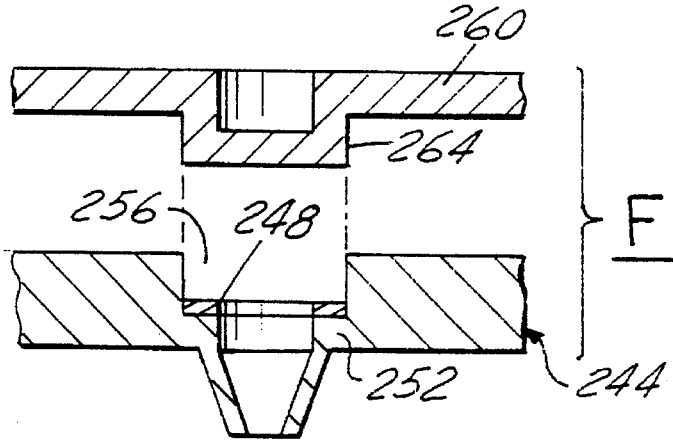
FIG. 13 is a fragmentary cross-sectional elevational view of one well of a multi-well plate having individual gaskets in accordance with one aspect of the present invention.
Figure 13A:
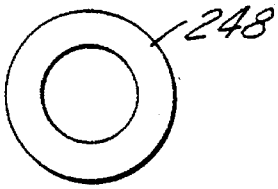
FIG. 13A is a plan view of an individual gasket for use in the device of FIG. 13.
Figure 14:
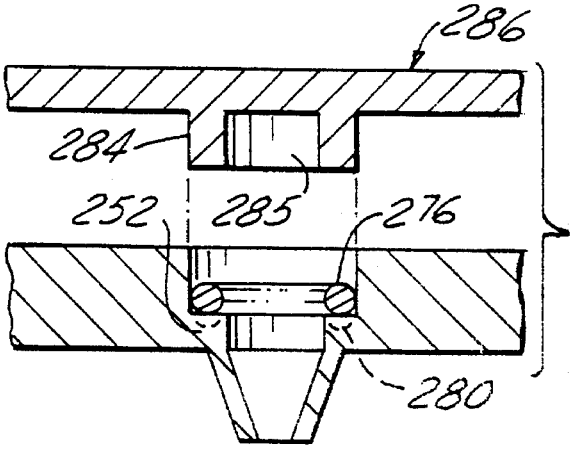
FIG. 14 is a fragmentary cross-sectional elevational view of one well of a multi-well plate having individual gaskets in accordance with the present invention.

In still another embodiment, and referring now to FIGS. 13 and 13A, gasket 248 is shown as a discrete element inserted into recess or bore 256 of plate 244. Again, plate 244 is illustrated with a single well unit broken-out from the plate or tray. Gasket 248 is disposed on shoulder 252 of plate 244. Accordingly, lid 260 includes a projection or collar 264 which mates with shoulder 252 when shoulder 264 is inserted into bore 256. A similar arrangement is shown in FIG. 14 with two modifications. In the apparatus shown in FIG. 14, the gasket comprises an O-ring 276 which may rest on shoulder 252 or which may be disposed in an annular channel 280 formed in shoulder 252, channel 280 being shown in phantom. In this embodiment, lid 286 has a projection or annular collar 284 with a central bore such that it mates only with O-ring 276 when closed. Lids 260 and 286 are essentially interchangeable in FIGS. 13 and 14. Lid 286 may comprise a solid projection 284 by simply filling in space 285 during the molding process. For the embodiments shown in FIGS. 13 and 14, the assembly may be clamped in any suitable manner.

Thus, it is apparent that there has been provided in accordance with the invention a method and apparatus that fully satisfies the objects, aims and advantages set forth above. While the invention has been described in connection with specific embodiments thereof, it is evident that many alternatives, modifications, and variations will be apparent to those skilled in the art in light of the foregoing description. Accordingly, it is intended to embrace all such alternatives, modifications and variations that fall within the spirit and broad scope of the appended claims.

What is claimed is:

1. An assembly for simultaneously confining multiple samples in separate chambers during thermal equilibration, comprising:

a plate defining a plurality of containment wells, each well having an opening at a principal surface of said plate;

a compressible gasket disposed on and extending over the majority of said principal surface of said plate, said compressible gasket having a plurality of holes in register with said wells; and a lid disposed on said compressible gasket, said lid having a surface for compressing said compressible gasket on said principal surface of said plate to form a seal and close said wells to define individual closed well chambers, thereby preventing said samples from flowing from one well chamber to another between said lid and said principal surface of said plate during thermal equilibration.

2. The apparatus cited in claim 1, wherein said plate and said containment wells are an array of tubes mounted in a tray.

3. The apparatus recited in claim 1, further comprising a thermal equilibration sheet disposed on said compressible gasket.

4. The apparatus recited in claim 1, wherein said compressible gasket is formed of a material selected from the group consisting of silicone rubber, sodium polysulfide, polychloroprene, and butadiene-styrene copolymers.

5. The apparatus recited in claim 4, further comprising a clamp which clamps said plate, said compressible gasket and said lid together.

6. The apparatus recited in claim 4, wherein said holes of said gasket have diameters less than that of said well openings.

* * * * *